US005792339A

United States Patent [19]

Russell

[11] Patent Number: 5,792,339

[45] Date of Patent: Aug. 11, 1998

[54] DIESEL FUEL

[75] Inventor: Robert L. Russell, Costa Mesa, Calif.

[73] Assignee: Tosco Corporation, Stamford, Conn.

[21] Appl. No.: 722,309

[22] Filed: Oct. 8, 1996

Related U.S. Application Data

[63] Continuation of Ser. No. 240,249, May 10, 1994, abandoned.

[51] Int. Cl.[6] ..... C10L 1/08

[52] U.S. Cl. ..... 208/15; 585/14; 585/1; 44/300

[58] Field of Search ..... 208/15; 585/14, 585/1; 44/300

[56] References Cited

U.S. PATENT DOCUMENTS

| | | | |
|---|---|---|---|
| 4,415,436 | 11/1983 | Angevine | 208/15 |
| 4,643,820 | 2/1987 | Zarrineghbal et al. | 208/15 |
| 4,645,585 | 2/1987 | White | 585/14 |
| 4,746,420 | 5/1988 | Darian et al. | 208/15 |
| 4,846,959 | 7/1989 | Kennedy et al. | 585/14 |
| 5,210,347 | 5/1993 | Chen et al. | 585/14 |
| 5,316,658 | 5/1994 | Ushio et al. | 208/15 |
| 5,389,111 | 2/1995 | Nikanjam et al. | 44/300 |
| 5,389,112 | 2/1995 | Nikanjam et al. | 44/300 |

OTHER PUBLICATIONS

Ullman et al., "Effects of Fuel Aromatics, Cetane Number, and Cetane Improver on Emissions from a 1991 Prototype Heavy-Duty Diesel Engine", Oct. 1990.

Nikanjam, "Development of the First Carb Certified California Alternative Diesel Fuel", Mar. 1993.

R. J. Stradling et al, "The Influence of Fuel Properties and Test Cycle Procedures on the Exhaust Particulate Emissions from Light-Duty Diesel Vehicles," I. Mech. E. International Seminar, Fuels for Automotive and Industrial Diesel Engines, London 6–7, Apr. 1993. MEP London 1993.

P.Heinze, "The Influence of Diesel Fuel Properties and Components on Emissions From Diesel Engines", I. Mech. E. International Seminar, Fuels for Automotive and Industrial Diesel Engines, London 6–7 Apr. 1993. MEP London 1993.

L.T. Cowley et al., "The Influence of Composition and Properties of Diesel Fuel on Particulate Emissions From Heavy-Duty Engines," SAE Technical Paper Series 932732, 1993 SAE Fuels & Lubricants Meeting and Exposition, Philadelphia, Pennsylvania, Oct. 18–21, 1993, pp. 13–48.

Christopher I. McCarthy et al., "Diesel Fuel Property Effects on Exhaust Emissions From a Heavy Duty Diesel Engine That Meets 1994 Emissions Requirements," SAE Technical Paper Series 922267, International Fuels and Lubricants Meeting and Exposition, San Francisco, California, Oct. 19–22, 1992, pp. 1–23.

W.E. Betts et al., "The Influence of Diesel Fuel Properties on Particulate Emissions in European Cars," SAE Technical Paper Series 922190, International Fuels and Lubricants Meeting and Exposition, San Francisco, California, Oct. 19–22, 1992, pp. 1–21.

W.W. Lange, "The Effect of Fuel Properties on Particulates Emissions in Heavy-Duty Truck Engines Under Transient Operating Conditions," SAE Technical Paper Series 912425, International Fuels and Lubricants Meeting and Exposition, Toronto, Canada, Oct. 7–10, 1991, pp. 1–24.

X. Montagne et al., "Relation Between Chemical Composition and Pollutant Emissions from Diesel Engines," Thirteenth World Petroleum Congress, Topic 16: Fuels–Gas Oil, Buenos Aires, Argentina 1991, pp. 1–9. (no month).

Ari Juva et al., "Influence of Diesel Fuel Composition on Performance and Exhaust Emissions of Diesel Engines," Thirteenth World Petroleum Congress, Topic 16: Fuels–Gas Oil, Buenos Aires, Argentina, 1991, pp. 1–7. (no month).

R. Lindsay et al., "Automotive Diesel Fuel: The Balance Between Cost–Effectiveness and Environmental Acceptability," Thirteenth World Petroleum Congress, Topic 16: Fuels–Gas Oil, Buenos Aires, Argentina, 1991, pp. 1–9. (no month).

Fabio Monti et al., "Fuel Quality Effects On Emissions of Compression Ignition Engines," Thirteenth World Petroleum Congress, Topic 16: Fuels–Gas Oil, Buenos Aires, Argentina, 1991, pp. 1–10.

Hirotsugu Nomura et al., "Effects of Fuel Properties on Diesel Exhaust Emissions," Thirteenth World Petroleum Congress, Topic 16: Fuels–Gas Oil, Buenos Aires, Argentina, 1991, pp. 1–8. (no month).

*Primary Examiner*—Walter D. Griffin

*Attorney, Agent, or Firm*—Gregory F. Wirzbicki; Yale S. Finkle; Robert J. Baran

[57] ABSTRACT

A high aromatic, low sulfur No. 2-D diesel fuel, which, upon combustion, provides emission benefits at least equivalent to a 10 vol. % aromatics, low sulfur diesel fuel contains, in addition to more than 10 vol. % aromatics, at least one of (1) a Cetane number less than 55;

(2) a nitrogen content of at least 500 ppmw;

(3) a sulfur content of at least 250 ppmw; and (4) a polycyclic aromatics content of at least 5.0 wt. %.

36 Claims, No Drawings

DIESEL FUEL

This application is a continuation of application Ser. No. 08/240,249, filed May 10, 1994, now abandoned.

BACKGROUND OF THE INVENTION

This invention relates to diesel fuels, in particular to diesel fuels which, upon combustion, emit fewer pollutants than is the case for conventional diesel fuels.

Upon combustion in a vehicular diesel engine, diesel fuels are known to emit pollutants, for example, solid particulate matter (PM) e.g., soot, as well as gaseous pollutants, e.g., unburned hydrocarbons (HC), carbon monoxide (CO), and nitrogen oxides (NOx).

Minimizing the production of pollutants from vehicles operating with diesel fuels is important for both environmental and health reasons. Ever increasingly stringent specifications are being adopted in order to reduce pollutant emissions from diesel fuels. In California, for example, starting in October, 1993, the California Air Resources Board (CARB) mandated a maximum aromatics content for commercial diesel fuels of 10 volume percent (9.5 wt. %). As summarized in SAE Paper 930728 entitled "Development of the First CARB Certified California Alternative Diesel Fuel," by Manuch Nikanjam (1993) herein incorporated by reference in its entirety, CARB was persuaded from certain studies of the Coordinating Research Council that PM, CO, NOx and/or HC emissions, and especially NOx, "seemed to be reduced with fuel aromatics reduction."

However, mandating a decrease in diesel fuel aromatics from the pre-Oct. 1993 levels of well over 30 vol. % to 10 vol. % max. is not without substantial difficulties—in particular, the difficulty, if not impossibility, of oil companies having the capability of providing sufficient low aromatic diesel to satisfy all the vehicular diesel fuel needs in California. As a result, CARB permits some high aromatic diesel fuels (alternatively shorthanded herein as >10 vol. % aromatics) to be produced and sold if it can be established that the higher aromatic diesel fuel has combustion emissions properties at least equivalent to those of a standard 10% vol. % max. aromatic fuel. Subsection g of Section 2282, Title 13, California Code of Regulations, incorporated herein by reference in its entirety, describes the procedure for certifying diesel fuels of equivalent emissions reductions. In summary, a candidate fuel (meeting the usual ASTM D975 No. 2-D low sulfur diesel fuel specifications) is tested in a Detroit Diesel Corporation Series-60 engine (or other specific engine as designated by CARB) against a low aromatics (i.e., 10 vol. % max.) reference No. 2-D diesel fuel of the following properties:

TABLE 1

| 10% Aromatics Reference Fuel Specifications | | |
|---|---|---|
| Aromatics | ASTM D 1319 | 10 vol % Max |
| | ASTM D 5186 | 9.5 wt % max |
| Flash Point | ASTM D 93 | 54° C. Min. |
| Gravity | ASTM D 287 | 33–39 API |
| Natural Cetane Number | ASTM D 613 | 48 Min. |
| Nitrogen | ASTM D 4629 | 10 ppmw Max. |
| Polycyclic Aromatics | ASTM D 2425 | 1.4% wt. % Max. |
| Sulfur | ASTM D 2622 | 500 ppmw Max. |
| Distillation °C., ASTM D 86 | | |
| Initial Boiling Point | 171–216 | (340–420° F.) |
| 10% Recovered | 204–254 | (400–490° F.) |

TABLE 1-continued

| 10% Aromatics Reference Fuel Specifications | | |
|---|---|---|
| 50% Recovered | 243–293 | (470–560° F.) |
| 90% Recovered | 288–321 | (550–610° F.) |
| End Point | 304–349 | (580–660° F.) |

Once the candidate fuel is "certified" by CARB as providing equivalent emission benefits as the reference fuel, the oil producer can then market fuels deemed equivalent to the "certified" candidate fuel, i.e., diesel fuels having at least the cetane number of the "certified" candidate fuel, with a sulfur content, aromatic content, polycyclic aromatic hydrocarbon content, and nitrogen content no greater than the "certified" candidate fuel. In no event, however, due to both EPA and CARB regulations, can the sulfur content be greater than 500 ppmw, i.e., the diesel fuel must be a low sulfur No. 2-D diesel fuel.

In the discussion and claims to follow describing and defining the invention, respectively, the term "California certified diesel fuel" refers to a diesel fuel containing more than 10 vol. % aromatics (high aromatics fuel) which has been certified by CARB to provide at least equivalent emission benefits to a standard reference fuel in accordance with Subsection g of Section 2282, Title 13, California Code of Regulations. In addition, the following designated ASTM test methods, or modified test methods, are incorporated herein in their entirety by reference:

1. For determining Sulfur content, in ppmw, ASTM D 2622-92,
2. For determining Aromatics content, in wt. %, ASTM D 5186
3. For determining Polycyclic Aromatics content, in wt. %, Western States Petroleum Association modified ASTM D 5186 certified by CARB as equivalent to ASTM D 2425-83,
4. For determining Nitrogen content, in ppmw, ASTM D 4629-91,
5. For determining Cetane Number, ASTM D 613-86.

In the claims hereinafter, unless another test method is specifically referred to, the foregoing test methods will be applicable in determining sulfur, aromatics, polycyclic aromatics, nitrogen, and cetane number, respectively. Also incorporated herein in its entirety is the ASTM D 975-92a specification for diesel fuel. In addition, for reference, the conversion of vol. % aromatics to wt. % aromatics herein is in accord with the CARB-accepted formula:

$$\text{vol. \% Aromatics (by ASTM D 1319)} = 0.916 \text{ wt. \% Aromatics (by ASTM D 5186)} + 1.33.$$

SUMMARY OF THE INVENTION

The present invention is directed to a California high aromatics certified diesel fuel for engines in ground transport vehicles (in particular, trucks or cars equipped with diesel engines) having a relatively low cetane number (50.5 min.), a relatively high nitrogen content (1050 ppmw max.), a relatively high polycyclic aromatics content (8.6 wt. % max.), and a relatively high sulfur content (496 ppmw max.). The aromatics content is >10 vol. %, can be as high as 23.9 wt. %, and usually is in the 15 to 23 wt. % range.

The advantage provided by the fuel of the present invention, in comparison to the few other 10 vol.

%+aromatics California certified diesel fuels, is the greater flexibility in production. Specifically, while other California certified diesel fuels allow for aromatics up to about 23 wt. %, and in some cases a bit higher, such fuels have one or more drawbacks—and usually more than one—in that the minimum cetane number is excessively high or the maximum nitrogen, sulfur, and/or polycyclic aromatic contents are too low to permit easy production from a number of different blending stocks.

DETAILED DESCRIPTION OF THE INVENTION

Diesel fuels are liquid hydrocarbonaceous substances of particular usefulness as a fuel for operating diesel engines in automobiles, trucks, and locomotives. Diesel fuel combustion results in the production of exhaust emissions which are a source of air pollution. The present invention provides a diesel fuel which, upon combustion in a diesel engine, reduces these exhaust emissions.

A major discovery in this invention is that two high aromatics diesel fuels, denominated herein as TF-1 and TF-3, reduce exhaust emissions to levels typical for low aromatic diesel fuels. The specific properties of TF-1 and TF-3 are set forth in the following Table 2:

TABLE 2

| Property | Fuel TF-1 | Fuel TF-3 |
|---|---|---|
| Sulfur, ppmw | 487 | 496 |
| ASTM D 2622, Aromatics, wt. % | 23.9 | 23.3 |
| ASTM D 5186 Polycyclic Aromatics, wt. % | 6.3 | 8.6 |
| ASTM D 2425 Nitrogen, ppmw | 893 | 1050 |
| ASTM D 4629 Cetane Number | 55.6 | 50.7 |
| ASTM D 613 API Gravity | 41.0 | 40.9 |
| Viscosity, cSt @ 40° C. | 2.09 | 2.18 |
| Flash Point, °F. | 133 | 131 |
| ASTM D 86 Distillation Temp. (°F.) for % Recovered | | |
| IBP | 315 | 311 |
| T5 | 338 | 346 |
| T10 | 348 | 359 |
| T20 | 367 | 381 |
| T30 | 389 | 409 |
| T40 | 422 | 447 |
| T50 | 467 | 489 |
| T60 | 508 | 521 |
| T70 | 539 | 547 |
| T80 | 569 | 577 |
| T90 | 607 | 616 |
| T95 | 635 | 643 |
| EP | 654 | 663 |
| % Rec | 97.9 | 98.0 |
| % Botts | 1.4 | 1.5 |
| Water and Sediment, % Vol | <0.01 | <0.01 |
| Ash, % mass | <0.01 | <0.01 |
| Copper Strip Corrosion 3 hr @ 50 C. | 1A | 1A |
| Ramsbottom Carbon Residue on 10% Botts, % mass | 0.1 | 0.1 |

Both TF-1 and TF-3 have been certified in California as providing emission benefits at least equivalent to the emission benefits from the 10 vol. % aromatic standard reference fuel. See State of California, Air Resources Board, Executive Orders Nos. G-714-012 & G-714-013, respectively.

In light of the foregoing, the invention, in one embodiment, provides a >10 vol. % aromatics California certified diesel fuel composition having one or more of the following properties:

(1) a Cetane number less than 55;

(2) a nitrogen content of at least 500 ppmw;

(3) a sulfur content of at least 250 ppmw; and (4) a polycyclic aromatics content of at least 5.0 wt. %.

In the preferred embodiment, the invention takes advantage of the fact that it provides high aromatics California certified diesel fuel compositions in which the ranges for Cetane number, nitrogen content, sulfur content, and polycyclic aromatics content have been expanded as compared to what is possible with other certified fuels. Specifically, in the preferred embodiment, the diesel fuel of the invention (A) contains more than 10 volume percent aromatics, more preferably at least 15 wt. %, and most preferably at least 20 wt. % aromatics, and (B) has at least one, more preferably at least two, still more preferably at least three, and most preferably, all four of the following properties:

(1) a Cetane number not less than 50.5 but less than 55;

(2) a nitrogen content of at least 500 ppmw but no greater than 1050 ppmw;

(3) a sulfur content of at least 250 ppmw but no greater than 495 ppmw; and (4) a polycyclic aromatics content of at least 5.0 wt. % but no greater than 8.6 wt. %.

The following Table 3 contrasts the properties of California "certified" TF-1 and TF-3 diesel fuels of the invention with other California "certified" fuels, as well as three other fuels described in more detail in the footnote below the table:

TABLE 3

| Fuel Designation | Max. Sulfur ASTM D 2622 ppmw | Max. Aromatics ASTM D 5186 wt. % | Max. Polycyclic Aromatics ASTM D 2425 wt. % | Max. Nitrogen ASTM D 4629 ppmw | Min. Cetane Number ASTM D 613 |
|---|---|---|---|---|---|
| TF-1 | 487 | 23.9 | 6.3 | 893 | 55.6 |
| TF-3 | 496 | 23.3 | 8.6 | 1050 | 50.7 |
| ARCO D-25 | 33 | 21.7 | 4.6 | 20 | 55.2 |
| ARCO D-26 | 42 | 24.7 | 4.0 | 40 | 56.2 |

TABLE 3-continued

| Fuel Designation | Max. Sulfur ASTM D 2622 ppmw | Max. Aromatics ASTM D 5186 wt. % | Max. Polycyclic Aromatics ASTM D 2425 wt. % | Max. Nitrogen ASTM D 4629 ppmw | Min. Cetane Number ASTM D 613 |
|---|---|---|---|---|---|
| Chevron D4781 | 54 | 19 | 2.2 | 484 | 58 |
| Chevron F2 | 196 | 19 | 4.4 | 466 | 59 |
| Chevron G2 | 202 | 15 | 3.6 | 341 | 55 |
| TEXACO* (Wilmington, CA) | <5 | 19.4 | 1.9 | 290 | 56.9 |

Note:
Data reported above for fuels TF-1, TF-3, D-25, D-26, and D4781 taken from CARB executive orders certifying these fuels by name with the properties indicated, max & min. Data for F2 and G2 taken from SAE Paper 930728 indicating that fuels named F2 and G2 "passed" the certification test but these fuels were apparently still awaiting successful certification by CARB at the time of publication of SAE Paper 930728. Also, Texaco's California certified maximum and minimum fuel properties are still proprietary; hence, the data above for the Texaco fuel are the actual values reported from an analysis of a commercial sample taken in November, 1993 in Wilmington, Calif.

As shown in the foregoing Table 3, the certified fuels of the invention, TF-1 and TF-3, have a nitrogen content, sulfur content, and polycyclic aromatics content higher than any of the other fuels listed. In addition, TF-3 has the lowest cetane number, and TF-1 and TF3 at 23.3 and 23.9 wt. % aromatics, respectively, are virtually equal to the highest reported value of 24.7 wt. % aromatics content for the ARCO D-26 fuel.

A review of the data in Table 3 shows that the diesel fuels of the invention provide an oil refiner the advantage of producing and marketing a diesel fuel environmentally equivalent to a 10 vol. % aromatics diesel fuel but with far greater flexibility and freedom of operation than is possible in the production of other certified fuels. In particular, a wider variety of blending stocks—e.g., light diesel fractions, heavy diesel fractions, turbine fuels, unconverted oils, stove distillates, etc—can be used to produce a low sulfur No. 2-D diesel fuel suitable for combustion in ground transport vehicles in California. For example, blending stocks are available in a wide variety of nitrogen values, but where the other fuels are limited to a combination of blending stocks yielding a maximum of 484 ppmw nitrogen (and a mere 40 ppmw in the case of the ARCO fuels), the blending stocks suitable for the invention are a combination providing for as much as 1050 ppmw nitrogen. A further analysis of the data in Table 3 will show a similar advantage with respect to blend combinations needed for polycyclic aromatics (a blend combination yielding as much as 8.6 wt. % polycyclics versus a maximum of 4.6 wt. % for all the other fuels, with some providing for no more than about 2.0 wt. % polycyclic aromatics), sulfur (a blend combination yielding as much as 496 ppmw sulfur versus a maximum of 202 ppm for all the other fuels, with some providing for no more than about 33 ppm sulfur), and cetane number (a blend combination yielding a cetane number as low as 50.7 versus a minimum of 55 for all the other fuels, with some requiring a minimum cetane number as high as 59).

An especially important advantage pertains to the high nitrogen value and low cetane number permitted in the fuels of the invention. Many commercial cetane enhancers (i.e., an additive which increases cetane number) have a nitrogen base, e.g., 2 ethylhexyl nitrate, as well as known amine-based cetane enhancers. Use of such cetane enhancers is drastically limited for the six fuels below TF-3 in Table 3 because, in contrast to TF-3, the maximum permissible nitrogen value is 484 ppmw as compared to the 1050 ppmw value for TF-3. Indeed, nitrogen-containing cetane enhancers are virtually precluded from use with the two ARCO fuels due to their maximum permissible nitrogen content in the 20–40 ppmw range.

In light of the foregoing, it can be seen that the degree of flexibility offered by the fuel of the invention directly increases with increasing nitrogen, sulfur, and/or polycyclic aromatics values permitted in, and/or decreases in the cetane number desired in, the final product. As an illustration, in comparison to the ARCO D-26 fuel, the invention provides a 20 wt. %+aromatics fuel of emission benefits equivalent to a 10 vol % aromatics fuel while permitting the presence of over 10 times as much sulfur, over twice as much polycyclic aromatics, over 25 times as much nitrogen, and with a range for cetane number enlarged by 5 points. In fact, none of the six fuels listed below TF-3 permits a Cetane number less than 55, or a nitrogen content of at least 500 ppmw, or a sulfur content of at least 250 ppmw, or a polycyclic aromatics content of at least 5.0 wt. %—much less allow for any combination of these four properties as permitted in the certified fuel of the invention.

In U.S. Pat. No. 5,288,393, herein incorporated by reference in its entirety, a gasoline composition is described having combustion emission benefits, which, as explained therein, are best taken advantage of when the gasoline is used to operate a large number of automobiles rather than a single automobile. The same is true in the present invention. The California certified fuels of the present invention can be used to advantage even for operation of a single vehicle, but clearly, the benefits increase directly as the number of engines in which it is used increases. Thus, in the most preferred embodiment of the invention, a method is provided to reduce, or aid in reducing, the amount of air pollution caused by motor vehicles, including vehicles powered by diesel fuel in a diesel engine, the method comprising:

(A) producing a low sulfur California certified No. 2-D diesel fuel of the invention, from an oil refinery or the like;

(B) delivering the diesel fuel to a substantial number of distribution points within California, and especially to an area having a significant or substantial smog problem, e.g., the South Coast Air District; and (C) dispensing the produced diesel fuel from said distribution points into a substantial number of diesel engine-equipped ground transport vehicles, e.g., automobiles, trucks, or tractors.

The amount of fuel produced and delivered in this method should be substantial, resulting, for example, in the production and delivery of at least 10%, preferably at least 25%, of the amount of total diesel fuel produced from a single oil refinery on a given day. Preferably, over the course of one week, and more preferably over the course of four weeks, the amount of fuel so produced and delivered would equal at least 10%, and preferably at least 25%, of the amount of diesel fuel produced from the refinery during the one and four week time periods, respectively. In another embodiment, the amount of California certified diesel fuel produced and delivered in a given day from a refinery for ultimate introduction into ground transport vehicles is at least 250,000, preferably at least 500,000, more preferably at least 750,000, and most preferably of all, at least 1,000,000 gallons. In yet another embodiment, the oil refinery, over a one week time period, and preferably over a four week time period, would produce and deliver to the ground-transport distribution points, on an average daily basis, at least 250,000, preferably at least 500,000, more preferably at least 750,000, and most preferably of all, at least 1,000,000 gallons of the California certified fuel of the invention.

In the foregoing discussion, it will be understood that the words "reducing" or "reduce" in the context of lowering CO, HC, PM, and/or NOx emissions are relative terms. As described in U.S. Pat. No. 5,288,393 in column 3 at lines 40 to 60, there of necessity will be some combustion emissions regardless what fuel is combusted, but in the invention, one aim is to provide for a fuel, which, upon combustion, produces less emissions than would otherwise pertain for conventional diesel fuels. Hence, logic dictates in the context of this invention that "reducing" is in comparison to results achievable with typical diesel fuels.

The invention has been described in conjunction with several of its embodiments, including the preferred embodiments. Modifications, variations, and substitutions can be made thereto without departing from the spirit and scope of the invention now to be claimed. As but one example, although it is contemplated that, typically, the combustion emissions from the diesel engine would be passed directly to the atmosphere as exhaust, one can, if desired, first pass the combustion emissions through a particulate trap for enhanced soot reduction. It is intended therein that this, and other such modifications, variations, and substitutions as fall within the spirit and scope of the invention, are encompassed within the claimed subject matter.

I claim:

1. A diesel fuel meeting the requirements of ASTM D 975 for a low sulfur No. 2-D diesel and providing emission benefits at least equivalent to a 10 vol. % aromatics diesel fuel as per Section 2282(g), Title 13, California Code of Regulations, said fuel containing from 10 vol. % to 23.9 wt. % aromatics and having a Cetane number of at least 50.7 and at least one of the following properties:

(1) a Cetane number of at least 50.7 but less than 54;

(2) a nitrogen content of at least 500 ppmw but no greater than 1050 ppmw;

(3) a sulfur content of at least 250 ppmw but no greater than 495 ppmw; and (4) a polycyclic aromatics content of at least 5.0 wt. % but no greater than 8.6 wt. %.

2. A diesel fuel as defined in claim 1 having at least two of the following properties:

(1) a Cetane number less than 54;

(2) a nitrogen content of at least 500 ppmw;

(3) a sulfur content of at least 250 ppmw; and (4) a polycyclic aromatics content of at least 5.0 wt. %.

3. A diesel fuel as defined in claim 1 having at least one of the following properties:

(1) a Cetane number less than 53;

(2) a nitrogen content of at least 600 ppmw;

(3) a sulfur content of at least 300 ppmw; and (4) a polycyclic aromatics content of at least 5.5 wt. %.

4. A diesel fuel as defined in claim 1 having at least one of the following properties:

(1) a Cetane number less than 52;

(2) a nitrogen content of at least 700 ppmw;

(3) a sulfur content of at least 400 ppmw; and (4) a polycyclic aromatics content of at least 6.0 wt. %.

5. A diesel fuel meeting the requirements of ASTM D 975 for a low sulfur No. 2-D diesel and providing emission benefits at least equivalent to a 10 vol. % aromatics diesel fuel as per Section 2282(g), Title 13, California Code of Regulations, said fuel containing from 15 wt. % to 23.9 wt. % aromatics and having a Cetane number of at least 50.7 and at least one of the following properties:

(1) a Cetane number of at least 50.7 but less than 54;

(2) a nitrogen content of at least 500 ppmw but no greater than 1050 ppmw;

(3) a sulfur content of at least 250 ppmw but no greater than 495 ppmw; and (4) a polycyclic aromatics content of at least 5.0 wt. % but no greater than 8.6 wt. %.

6. A diesel fuel as defined in claim 5 having at least two of the following properties:

(1) a Cetane number less than 54;

(2) a nitrogen content of at least 500 ppmw;

(3) a sulfur content of at least 250 ppmw; and (4) a polycyclic aromatics content of at least 5.0 wt. %.

7. A diesel fuel as defined in claim 5 having at least one of the following properties:

(1) a Cetane number less than 53;

(2) a nitrogen content of at least 600 ppmw;

(3) a sulfur content of at least 300 ppmw; and (4) a polycyclic aromatics content of at least 5.5 wt. %.

8. A diesel fuel as defined in claim 5 having at least one of the following properties:

(1) a Cetane number less than 52;

(2) a nitrogen content of at least 700 ppmw;

(3) a sulfur content of at least 400 ppmw; and (4) a polycyclic aromatics content of at least 6.0 wt. %.

9. A diesel fuel meeting the requirements of ASTM D 975 for a low sulfur No. 2-D diesel and providing emission benefits at least equivalent to a 10 vol. % aromatics diesel fuel as per Section 2282(g), Title 13, California Code of Regulations, said fuel containing from 20 wt. % to 23.9 wt. % aromatics and having a Cetane number of at least 50.7 and at least one of the following properties:

(1) a Cetane number of at least 50.7 but less than 55;

(2) a nitrogen content of at least 500 ppmw but no greater than 1050 ppmw;

(3) a sulfur content of at least 250 ppmw but no greater than 495 ppmw; and (4) a polycyclic aromatics content of at least 5.0 wt. % but no greater than 8.6 wt. %.

10. A diesel fuel as defined in claim 9 having at least two of the following properties:

(1) a Cetane number less than 55;

(2) a nitrogen content of at least 500 ppmw;

(3) a sulfur content of at least 250 ppmw; and (4) a polycyclic aromatics content of at least 5.0 wt. %.

11. A diesel fuel as defined in claim 9 having at least one of the following properties:

(1) a Cetane number less than 54;

(2) a nitrogen content of at least 600 ppmw;

(3) a sulfur content of at least 300 ppmw; and (4) a polycyclic aromatics content of at least 5.5 wt. %.

12. A diesel fuel as defined in claim 9 having at least one of the following properties:

(1) a Cetane number less than 53;

(2) a nitrogen content of at least 700 ppmw;

(3) a sulfur content of at least 400 ppmw; and (4) a polycyclic aromatics content of at least 6.0 wt. %.

13. A diesel fuel as defined in claim 9 having at least one of the following properties:

(1) a Cetane number less than 52;

(2) a nitrogen content of at least 800 ppmw;

(3) a sulfur content of at least 450 ppmw; and (4) a polycyclic aromatics content of at least 6.5 wt. %.

14. A diesel fuel as defined in any one of claims 1, 3, 4, 5, 7, 8, 9, or 11 to 13, inclusive, having at least two of said properties.

15. A diesel fuel as defined in claim 14 containing a nitrogen-containing cetane enhancer.

16. A diesel fuel as defined in any one of claims 1–4, 5–8, or 9–13, inclusive, having at least three of said properties.

17. A diesel fuel as defined in any one of claims 1–4, 5–8, or 9–13, inclusive, having all four of said properties.

18. A diesel fuel meeting the requirements of ASTM D 975 for a low sulfur No. 2-D diesel and providing emission benefits at least equivalent to a 10 vol. % aromatics diesel fuel as per Section 2282(g), Title 13, California Code of Regulations, said fuel containing from 10 vol. % to 23.9 vol. % aromatics and having a Cetane number of at least 50.7 but less than 55 and at least one of the following properties:

(1) a nitrogen content of at least 500 ppmw but no greater than 1050 ppmw;

(2) a sulfur content of at least 250 ppmw but no greater than 495 ppmw; and (3) a polycyclic aromatics content of at least 5.0 wt. % but no greater than 8.6 wt. %.

19. A diesel fuel meeting the requirements of a ASTM D 975 for a low sulfur No. 2-D diesel and providing emission benefits at least equivalent to a 10 vol. % aromatics diesel fuel as per Section 2282(g), Title 13, California Code of Regulations, said fuel containing from 15 wt. % to 23.9 wt. % aromatics and having a Cetane number of at least 50.7 but less than 55 and at least one of the following properties:

(1) a nitrogen content of at least 500 ppmw but no greater than 1050 ppmw;

(2) a sulfur content of at least 250 ppmw but no greater than 495 ppmw; and (3) a polycyclic aromatics content of at least 5.0 wt. % but no greater than 8.6 wt. %.

20. A diesel fuel meeting the requirements of ASTM D 975 for a low sulfur No. 2-D diesel and providing emission benefits at least equivalent to a 10 vol. % aromatics diesel fuel as per Section 2282(g), Title 13, California Code of Regulations, said fuel containing from 16 wt. % to 23.9 wt. % aromatics and having a Cetane number of at least 50.7 and at least one of the following properties:

(1) a Cetane number of at least 50.7 but less than 55;

(2) a nitrogen content of at least 500 ppmw but no greater than 1050 ppmw;

(3) a sulfur content of at least 250 ppmw but no greater than 495 ppmw; and (4) a polycyclic aromatics content of at least 5.0 wt. % but no greater than 8.6 wt. %.

21. A method for aiding in the reduction of air pollution caused in part by emissions from ground transport vehicles equipped with diesel engines operating on No. 2 diesel fuel, said method comprising the steps of:

(A) producing a low sulfur California certified No. 2-D diesel fuel as defined in any one of claims 1, 2, 5, 6, 9, 10, or 18–20, inclusive;

(B) delivering said produced diesel fuel to distribution points; and (C) dispensing the produced diesel fuel from said distribution points into diesel engine-equipped ground transport vehicles for subsequent combustion therein.

22. A method as defined in claim 21 wherein the amount of diesel fuel produced on an average daily basis in step (A) over a four week time period is at least 250,000 gallons.

23. A method as defined in claim 21 wherein all three steps are performed substantially daily over a one week time period.

24. A method as defined in claim 21 wherein all three steps are substantially regularly performed during a time period of four weeks.

25. A method as defined in claim 21 wherein the amount of diesel fuel produced on an average daily basis in step (A) and delivered in step (B) over a one week time period is at least 500,000 gallons.

26. A method as defined in claim 21 wherein the amount of diesel fuel produced on an average daily basis in step (A), delivered in step (B), and dispensed in step (C) over a four week time period is at least 750,000 gallons.

27. A method as defined in claim 21 wherein at least one of said three steps is performed with at least 250,000 gallons of said diesel fuel.

28. A method for operating a ground transport vehicle with reduction in the amount of at least one pollutant selected from the group consisting of $NO_x$, CO, unburned hydrocarbons, and particulate matter, said vehicle having a diesel engine, the method comprising combusting within said diesel engine a low sulfur No. 2-D diesel fuel as defined in any one of claims 1–4, 5–8, 9–13, or 18–20, inclusive.

29. A method for combusting a high aromatics diesel fuel in a diesel engine in a ground-transport vehicle so as to provide combustion emissions benefits at least equivalent to that provided by the combustion in a diesel engine of a diesel fuel containing only 10 volume percent aromatics and further having the following properties:

Natural Cetane Number 48 Min.

Nitrogen 10 ppmw Max.

Polycyclic Aromatics 1.4% wt. % Max.

Sulfur 500 ppmw Max.

said method comprising combusting within said diesel engine a diesel fuel as defined in any one of claims 1–4, 5–8, 9–13, or 18–20, inclusive.

30. A method for combusting a high aromatics diesel fuel in a diesel engine in a ground-transport vehicle so as to provide combustion emissions benefits at least equivalent to that provided by the combustion in said diesel engine of a diesel fuel containing only 10 volume percent aromatics and further having the following properties:

Natural Cetane Number 48 Min.

Nitrogen 10 ppmw Max.

Polycyclic Aromatics 1.4% wt. % Max.

Sulfur 500 ppmw Max.

said method comprising combusting within said diesel engine a diesel fuel as defined in claim 16.

31. A method for operating a ground transport vehicle with reduction in the amount of at least one pollutant selected from the group consisting of $NO_x$, CO, unburned hydrocarbons, and particulate matter, said vehicle having a diesel engine, the method comprising combusting within said diesel engine a low sulfur No. 2-D diesel fuel as defined in claim 14.

32. A method for operating a ground transport vehicle with reduction in the amount of at least one pollutant selected from the group consisting of $NO_x$, CO, unburned hydrocarbons, and particulate matter, said vehicle having a diesel engine, the method comprising combusting within said diesel engine a low sulfur No. 2-D diesel fuel as defined in claim 15.

33. A method for combusting a high aromatics diesel fuel in a diesel engine in a ground-transport vehicle so as to provide combustion emissions benefits at least equivalent to that provided by the combustion in a diesel engine of a diesel fuel containing only 10 volume percent aromatics and further having the following properties:

Natural Cetane Number 48 Min.

Nitrogen 10 ppmw Max.

Polycyclic Aromatics 1.4% wt. % Max.

Sulfur 500 ppmw Max.

said method comprising combusting within said diesel engine a diesel fuel as defined in claim 17.

34. A method as defined in claim 21 wherein said distribution points are within California.

35. A method as defined in claim 34 wherein the amount of diesel fuel produced on an average daily basis in step (A) and delivered in step (B) over a one week time period is at least 500,000 gallons.

36. A diesel fuel as defined in claims 1, 5, 9 or 18 wherein the average emissions of nitrogen oxides ($NO_x$), particulate matter (PM) and soluble organic fraction (SOF) produced by combusting said diesel fuel satisfies the following equation:

$$C<R+\text{Delta}-Sp\bullet\sqrt{2/n}\bullet t(a,\ 2n-2)$$

where:

C=Candidate fuel emissions

R=Reference fuel emissions

Delta=Tolerance level:

2% of R for $NO_x$

4% of R for PM, and

12% of R for SOF

Sp=Pooled standard deviation t=The one-sided upper percentage point of student's t distribution with a=0.15 and 2n−2 degrees of freedom n=Number of tests of candidate and reference fuel.

* * * * *